US005586941A

United States Patent [19]

Klearman

[11] Patent Number: 5,586,941

[45] Date of Patent: Dec. 24, 1996

[54] GOLF PUTTING PRACTICE DEVICE

[76] Inventor: Melvin Klearman, 739 Bergerac Dr., Creve Coeur, Mo. 63141

[21] Appl. No.: 587,845

[22] Filed: Jan. 11, 1996

[51] Int. Cl.[6] ..... A63B 69/36

[52] U.S. Cl. ..... 473/160; 473/162; 473/181

[58] Field of Search ..... 473/150, 151, 473/157, 158, 159–163, 170, 171, 172, 173, 174, 180, 181, 182, 184, 195

[56] References Cited

U.S. PATENT DOCUMENTS

| | | | |
|---|---|---|---|
| 1,662,864 | 3/1928 | Petersen | 473/160 |
| 2,144,439 | 1/1939 | Duffy | 473/160 |
| 3,762,718 | 10/1973 | Culley . | |
| 3,934,874 | 1/1976 | Henderson . | |
| 4,437,669 | 3/1984 | Pelz . | |
| 4,805,912 | 2/1989 | Hickman . | |
| 4,828,267 | 5/1989 | Goodrich . | |
| 5,100,145 | 3/1992 | Kim | 473/160 |
| 5,282,627 | 2/1994 | Beck . | |
| 5,362,057 | 11/1994 | Arima . | |
| 5,431,403 | 7/1995 | Pelz | 473/160 |
| 5,435,547 | 7/1995 | Lee . | |
| 5,437,458 | 8/1995 | Springer . | |

*Primary Examiner*—Mark S. Graham
*Attorney, Agent, or Firm*—Polster, Lieder, Woodruff & Lucchesi

[57] ABSTRACT

A golf putting practice device is provided which will enable a golfer to practice putts of varying distances in a small area. The device includes a base, a height indicator arm hingedly connected to the base, and a relatively short track (e.g., 6–7') along which a golfer putts. The track may be elevated at one end to a desired height and secured at that height to the height indicator arm. The height indicator arm is calibrated for the length of the track and the various heights to which the track is raised, such that when the track is raised to a certain height (e.g., 2'), a practice putt on the device will correspond to a putt of a desired distance (e.g., 30') on an actual putting green. The surface of the track can be altered to simulate a dry putting green or a wet putting green. Varying putting green conditions, i.e., varying frictional forces exerted against the ball by the putting green, can also be varied simply by varying the height to which the track is raised.

23 Claims, 10 Drawing Sheets

GOLF PUTTING PRACTICE DEVICE

BACKGROUND OF THE APPLICATION

This invention relates to golf putting practice devices, and in particular to a practice device which will allow a golfer to practice putting for various distances in a small area.

Many people have designed golf putting practice devices. Many of these practice devices are designed to help a golfer maintain the putter head perpendicular to the path of travel of the putter. Such practice devices are shown, for example, in U.S. Pat. Nos. 5,437,458 to Springer, 5,435,547 to Lee, 5,362,057 to Arima, 5,282,627 to Beck, 4,437,669 to Pelz, and 3,934,874 to Henderson. The practice devices shown in these patents may help a golfer to properly orient his putter, however, it will not allow a golfer to practice putting so as to learn the proper force needed to putt a golf ball a certain distance under specified conditions which affect path and speed and, therefore the successful outcome of the putt.

A few practice devices have been developed which will allow a putter to actually putt a golf ball. Such practice devices are shown, for example, in U.S. Pat. Nos. 4,828,267 to Goodrich, 4,805,912 to Hickman, and 3,762,718 to Culley. These practice devices are generally fixed. They do not allow for much variation in the effective putting distance.

SUMMARY OF THE INVENTION

One object of the present invention is to provide a golf putting practice device which will allow a golfer to practice putting a desired distance along a track which is shorter than that distance.

Another object is to provide such a practice device in which the length of the putt being practiced may be varied.

Another object is to provide such a practice device in which the condition which affects the path and speed of the golf ball may be varied.

Another object is to provide such a practice device which is small and compact such that it may be used in a small area.

These and other objects will become apparent to those skilled in the art in light of the following disclosure and accompanying drawings.

In accordance with the invention, generally stated, a golf putting practice device is provided which will allow a golfer to practice putts of varying distances and conditions in a small area. The golf putting practice device includes a base, a height indicator arm hingedly connected to the base, and a track, the end of which may be elevated to a desired height and includes a hole at its end into which a golf ball may fit. The track is mounted to a sub-base having at least a pivotal section. The pivotal section is pivotally or hingedly connected to the base. In one embodiment, the sub-base also includes a fixed section which is secured to the putting end of the base. In this embodiment, the pivotal end is hingedly connected to an end of the fixed section. The height indicator arm includes a plurality of spaced apart openings extending substantially along the centerline of its length and the sub-base includes a hook at its free end which is removably receivable in a desired opening in the height indicator arm to elevate the hole end of the track to a desired height. When the track is elevated, the force required to sink a golf ball in the hole at the end of the track will correspond to a putt with specified conditions which affect the path and speed of the ball on any putting green for any desired distance (i.e., from less than 7' to 60' or more) even though the track may be significantly shorter than the desired distance. Preferably, the height indicator includes indicia corresponding to the distance of a putt when the track sub-base is secured in a desired opening in the height indicator arm.

The track includes a flexible, preferably vinyl, putting sub-surface which is secured to the first section of the sub-base and/or the putting end of the base and a putting surface secured to the putting sub-surface. The putting sub-surface extends from the first end of the base to at least the hole in the sub-base such that the sub-base hole is exposed by the sub-surface. The putting surface includes an opening, preferably sized to be no larger in diameter to a standard golf hole. However, the difficulty of the putt can be increased by decreasing the size of the hole. Preferably, the hole is no smaller than 2" in diameter. A flexible hard board is shaped complimentary to the carpet and includes an opening equal in size to the putting surface hole and positioned to be co-axial with the putting surface hole.

The putting surface hole is aligned with the sub-base hole so that if the golf ball falls into the putting surface hole it will fall through the sub-base hole. A cup, formed preferably of a flexible netting, is provided to catch the ball. The hole of the sub-base second section has a length greater than the diameter of a standard golf. Thus, as the elevation of the track is changed, the sub-base hole will always be substantially exposed through the putting surface hole.

The putting sub-surface has a pair of spaced apart longitudinally extending ribs which define a center alley and a pair of side ribs, which, in cooperation with the first pair of ribs, define outer alleys. The putting surface is disposed in the center alley. A pair of elongate attachment bars are provided and disposed in the outer alleys and include fasteners which secure the track to the sub-base fixed section and/or the putting end of the base along a desired length of the track.

In a second embodiment of the practice device, the base is substantially wider than the track and the track is generally centered with respect to the base. This will allow the golfer to stand on the base, so that use of the practice device will more accurately reflect a putting stance on a putting green.

In a third embodiment, the height indicator arm, base, and sub-base are all formed from a single piece of wood. This will substantially reduce the weight of the device.

DESCRIPTION OF THE PREFERRED EMBODIMENT

Figure 1:
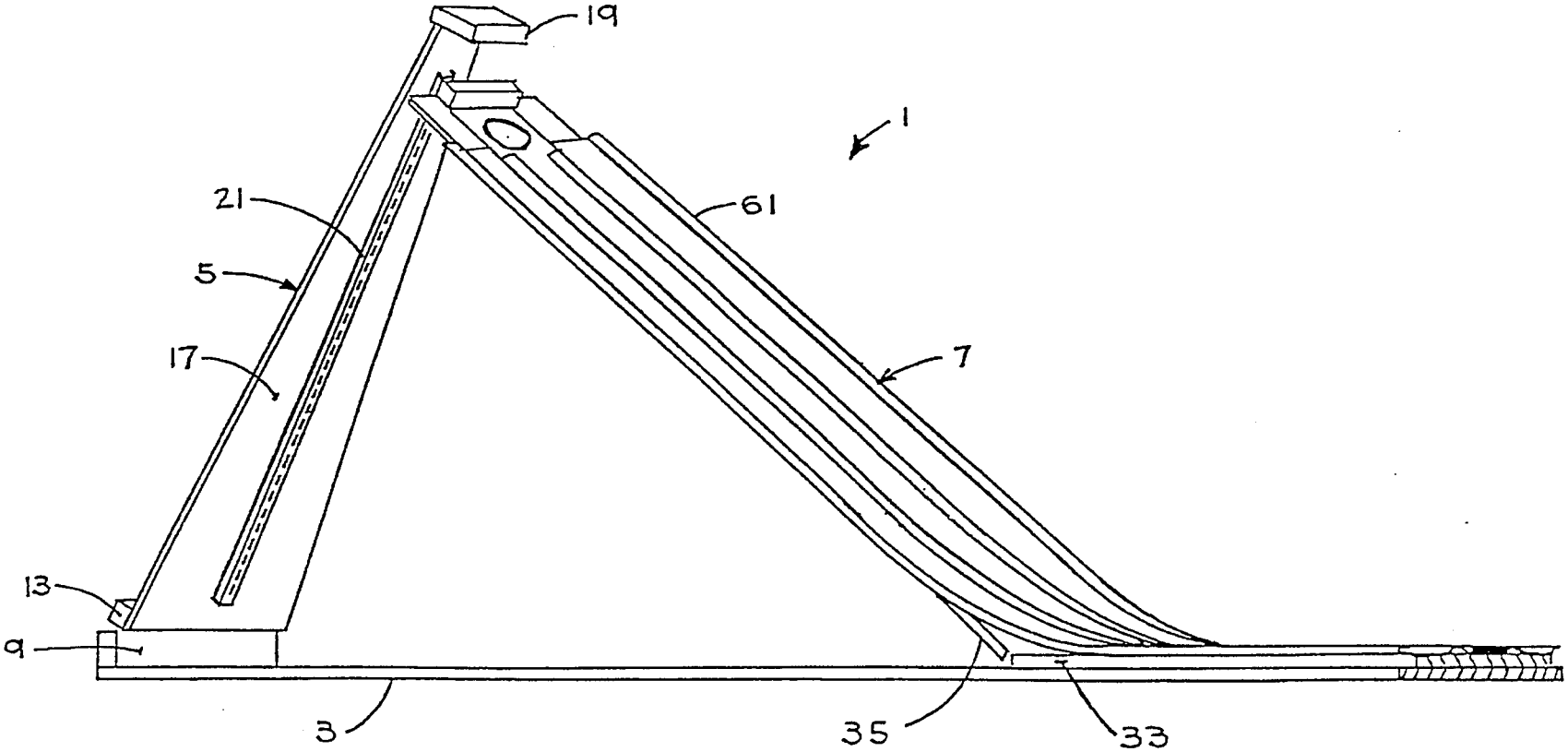
FIG. 1 is a perspective view of a golf putting practice device of the present invention; the device being in an assembled state, ready for use.
Figure 3:
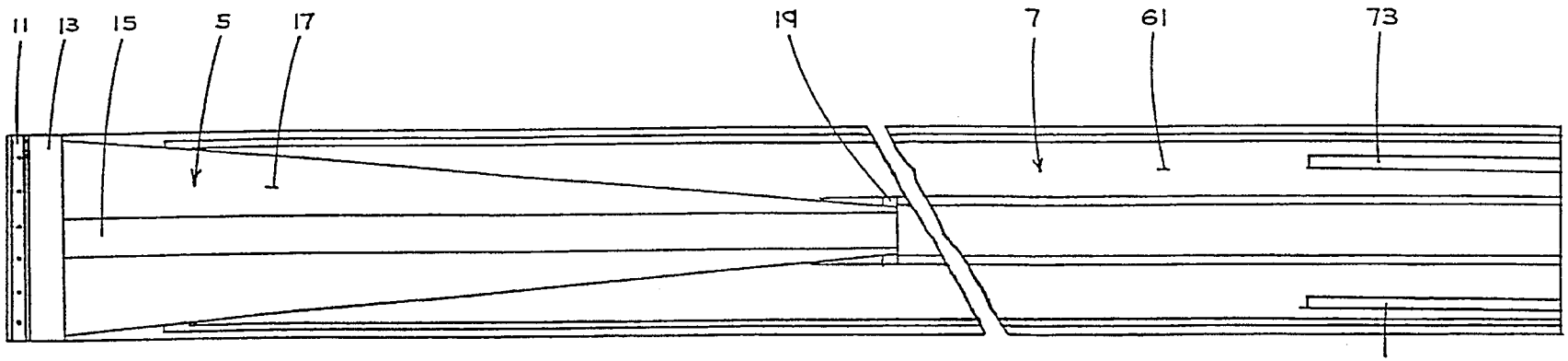
FIG. 3 is a top plan view of the device in its folded state.
Figure 2:
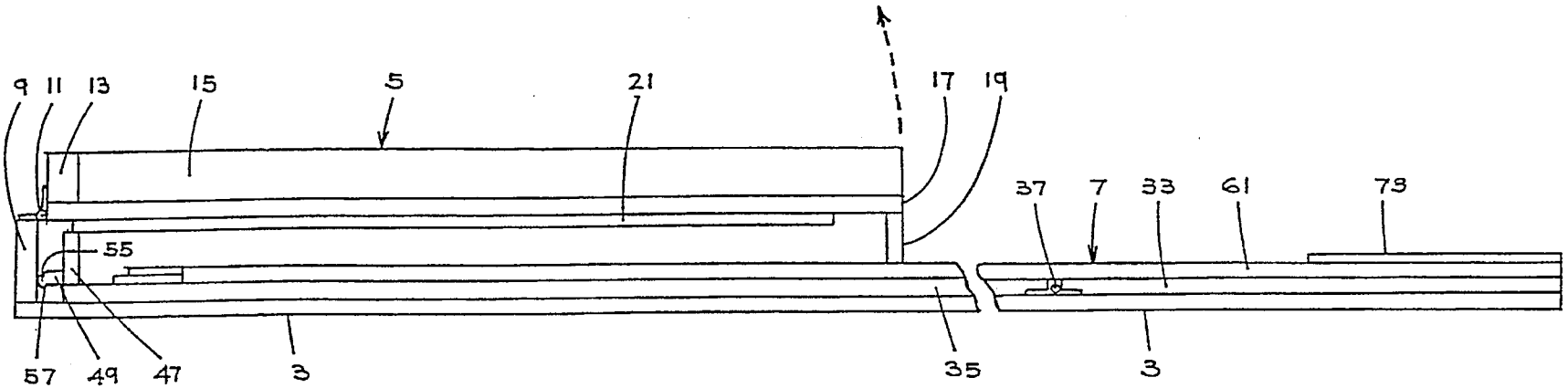
FIG. 2 is a side elevational view of the device in a folded state.
Figures 4, 5:
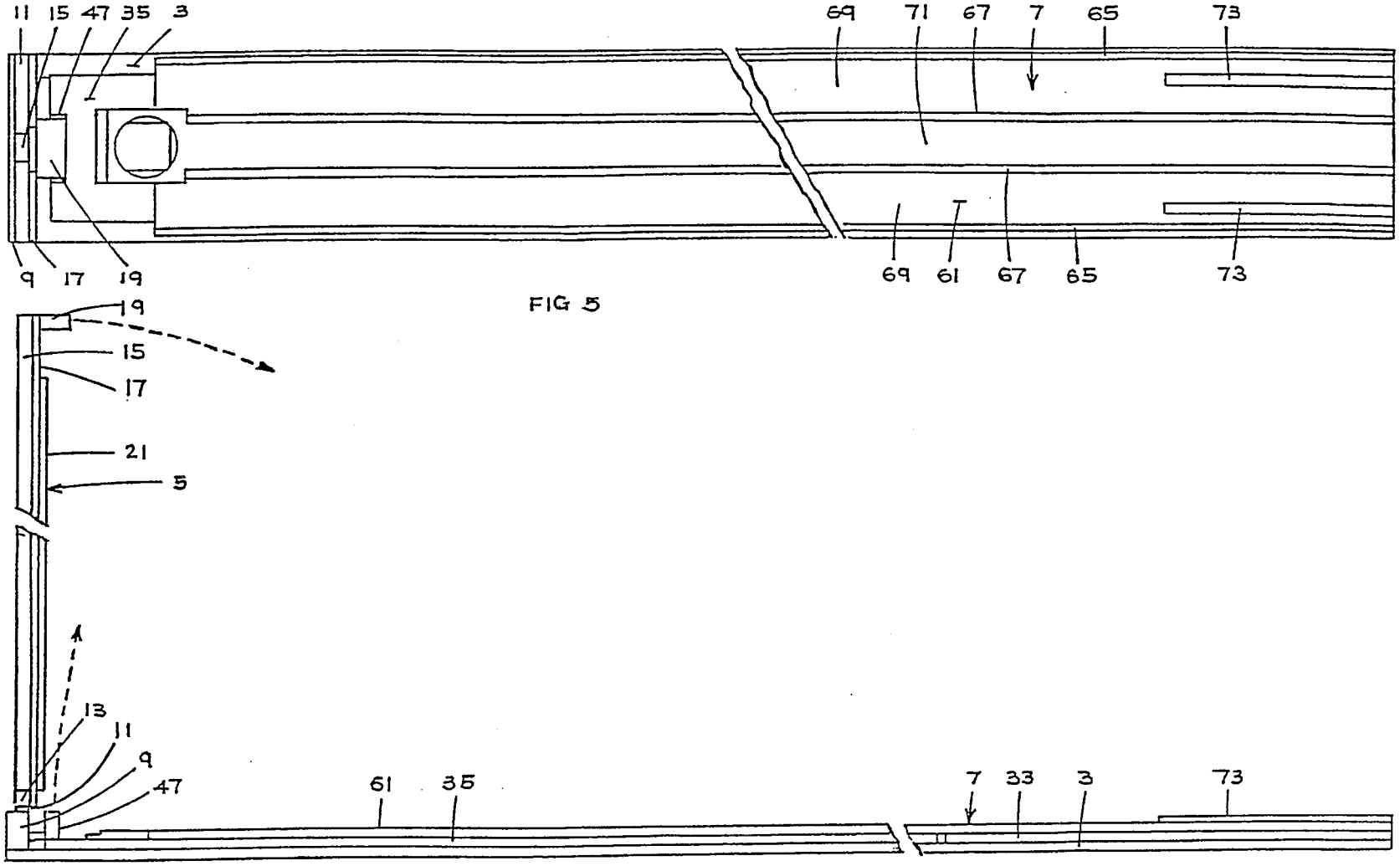
FIG. 4 is a side elevational view of the device with its height indicator arm pivoted up from the base.
FIG. 5 is a top plan view of the device with the height indicator arm pivoted to be generally perpendicular to the base.

A golf putting practice device 1 of the present invention is shown generally in FIG. 1. The practice device 1 includes a base 3 which lies along the ground, a height indicator arm 5 which is pivotally connected to the base, and a track 7 which in part lies along and on the base and in part is pivotal relative to the base. To enable the practice device 1 to be used indoors, the base is fairly short, preferably not more than 8' long. As can be seen in FIGS. 2 and 3, the practice device can be folded to a storage position in which the track 7 completely lies on the base 3 and the height indicator arm 5 is pivoted to be generally parallel to the base 3. To enable the arm 5 to lie generally parallel to the base 3 in the folded position, the arm 5 is mounted to a pedestal 9. A hinge 11, such as a piano hinge, mounts the arm 5 to the pedestal 9 for pivotal motion.

Figure 6:
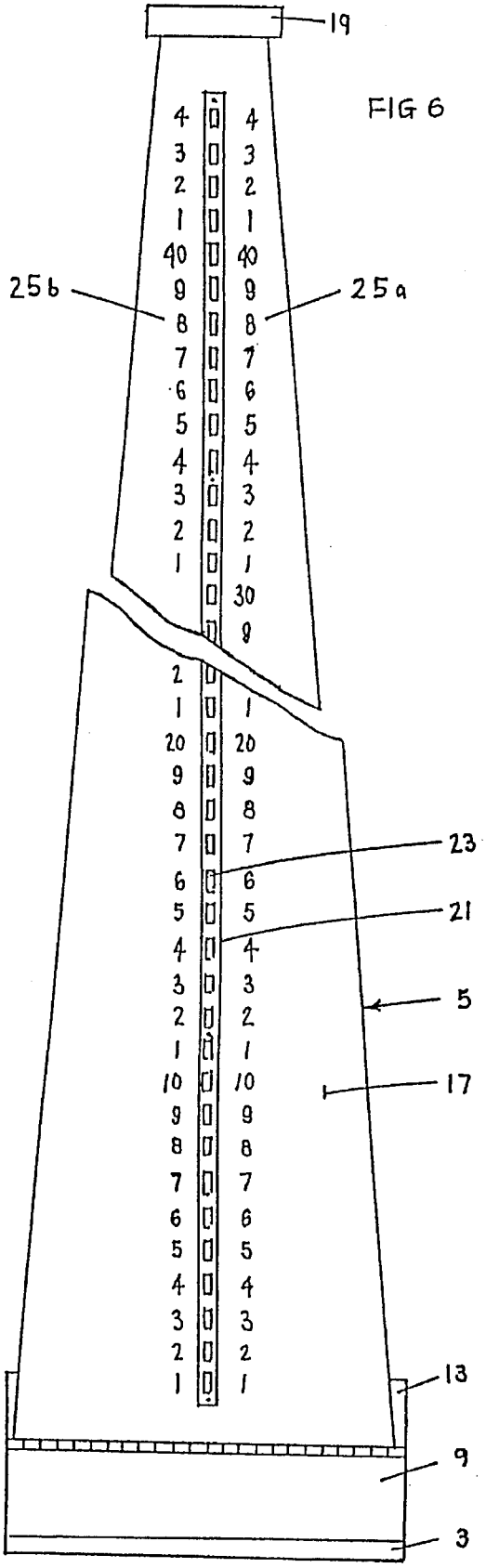
FIG. 6 is a front elevational view of the height indicator arm.
Figure 7:
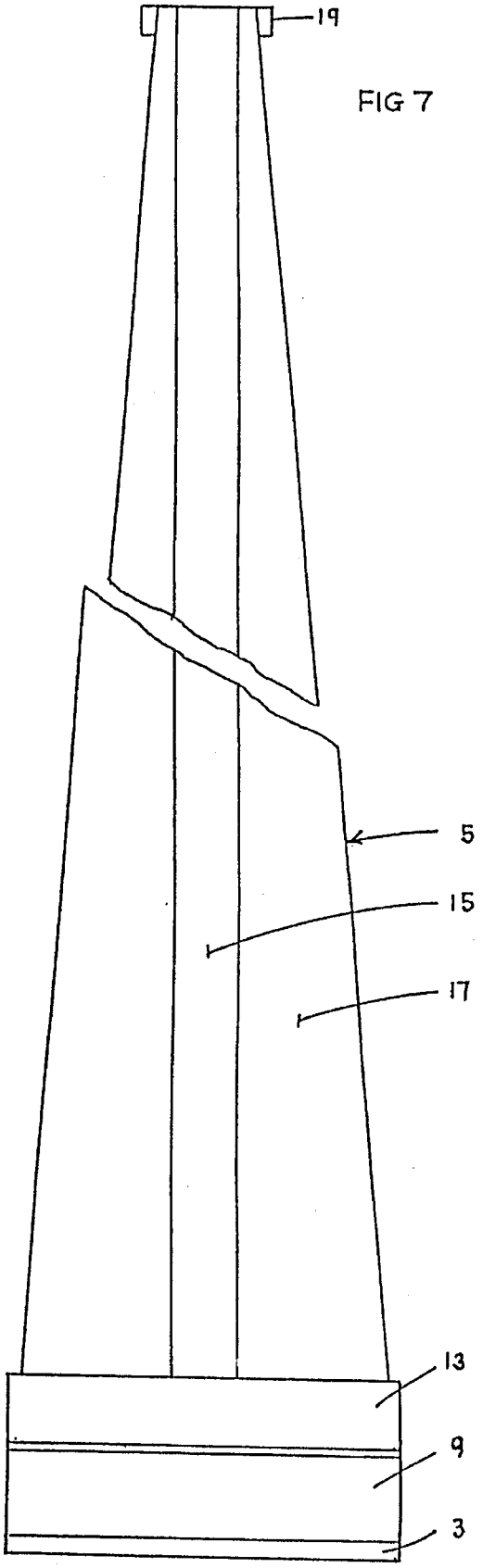
FIG. 7 is a rear elevational view of the height indicator arm.
Figure 8:
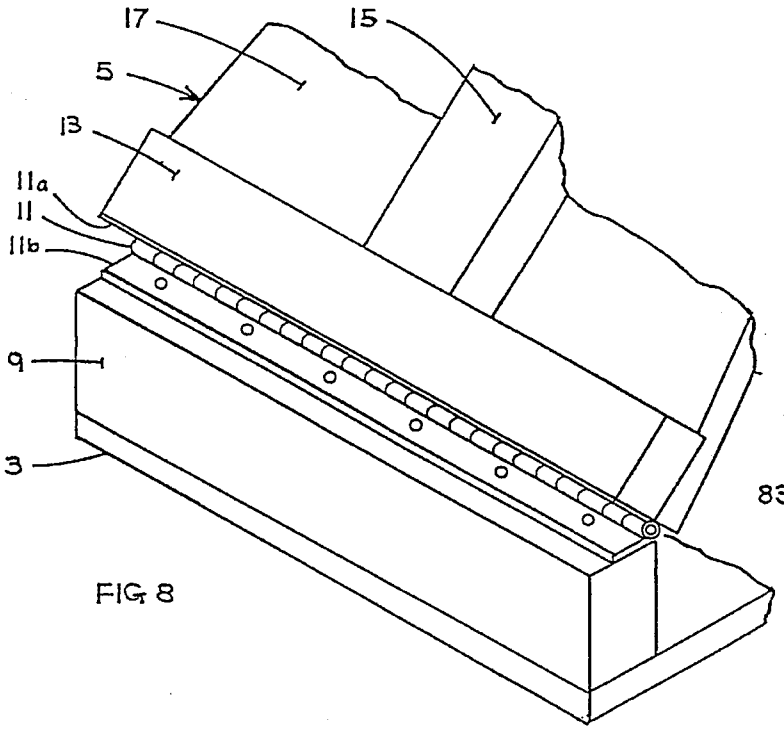
FIG. 8 is an enlarged perspective view of the hinge which connects the height indicator arm to the base.

The arm 5 is shown in more detail in FIGS. 6–8. The arm 5 includes a horizontal brace 13, the bottom surface of which is connected to a plate 11*a* of the hinge 11. The other plate 11*b* of the hinge is mounted to the top surface of the pedestal 9. A vertical brace 15 extends generally perpendicularly from the horizontal brace 13. A flat board 17 is mounted to the front surfaces of the braces 13 and 15. The board 17 is preferably trapezoidal in shape, but may be rectangular or any other desired shape. A handle 19 is secured to the top of board 17 to be generally perpendicular to the vertical brace 15. The handle 19 is approximately equal in height to the pedestal 9 and serves two functions. It serves as a handle to pivot the height indicator arm 5 relative to the base 3. It also serves as a spacer to space the arm 5 from the base 3 when the practice device 1 is placed in its folded position to prevent the hinge 11 from being over-extended. extended. The arm 5 also includes a vertical bracket 21 which extends substantially the full length of the board 17. As seen in FIG. 6, the bracket 21 is preferably centered with respect to the board 17 and is spaced slightly from the top and bottom of the board. The bracket 21 includes a plurality of co-linear openings 23 which are preferably equally spaced along the length of the bracket. As will be explained below, the track 7 can be selectively attached to the bracket 21 by engaging the track with a desired opening 23. Two sets of indicia 25*a* and 25*b* are provided on either side of the bracket. The indicia 25*a* and 25*b* are placed next to the openings 23 and correspond to a putting distance which is simulated when the track is engaged in the desired opening. Although the indicia are preferably placed next to each opening 23, the indicia need not be so placed and can be positioned, for example, next to every other opening. The indicia 25*a* and 25*b* may be calibrated to two different scales. For example, indicia 25*a* can correspond to putting distances for a dry putting green and indicia 25*b* can correspond to putting distances for a wet putting green. I have found that the arm 5 does not have to be very tall in order to provide a large effective putting distance. An overall length of less than 4.5' has been found to be quite effective. Of course, other lengths, either longer or shorter could be used.

Figure 10:
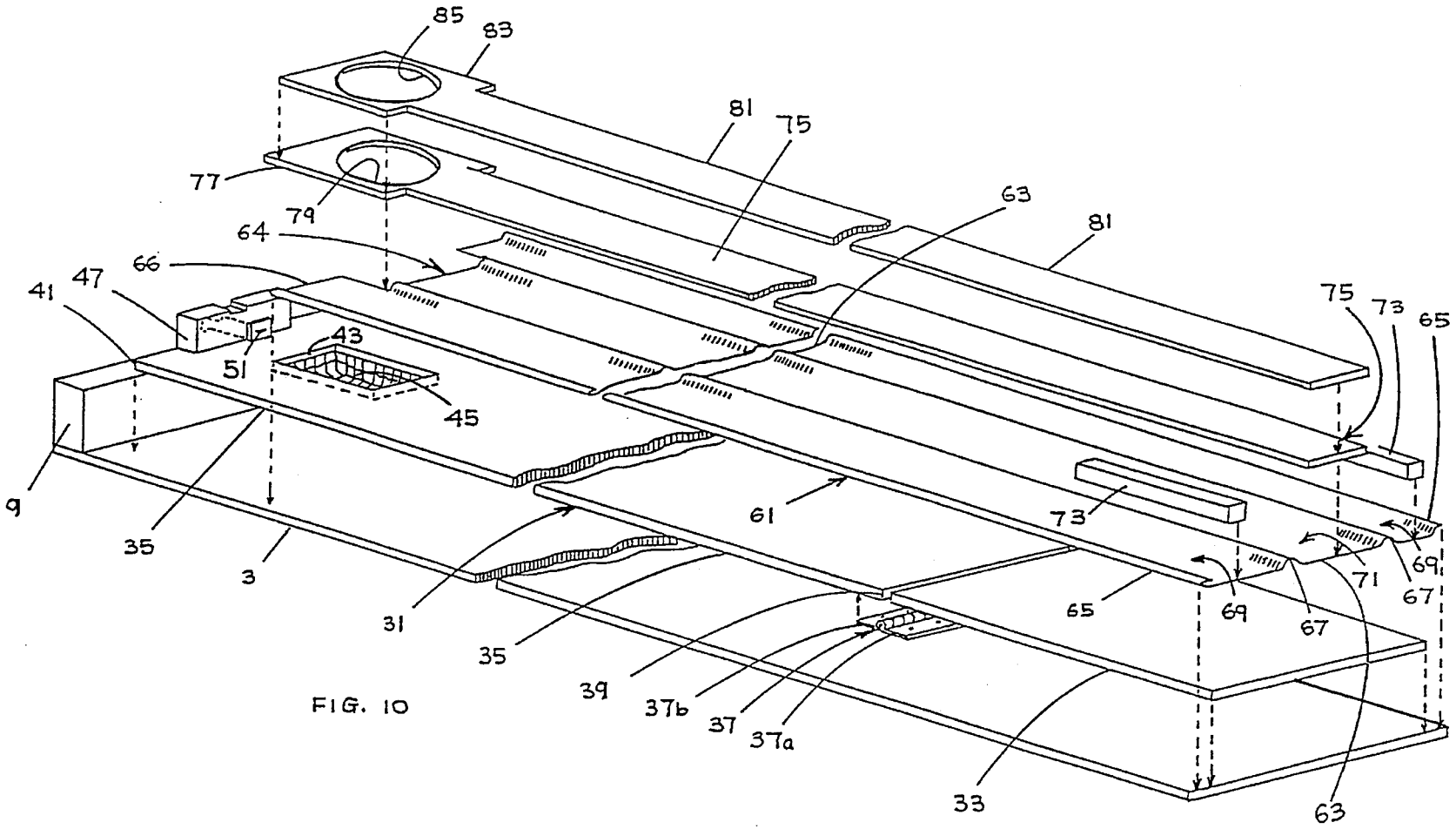
FIG. 10 is an exploded perspective view of the device, excluding the height indicator arm.

The construction and mounting of the track 7 is shown in detail in FIG. 10. Track 7 is mourned to a sub-base 31 formed of a first part 33 and a second part 35, which are connected together by a hinge 37. The sub-base 31 is slightly shorter than the base 3 and preferably has an overall length of about 7¾'. The second part 35 is substantially longer than the first part 33, and is preferably about twice the length of the first part 33. Like hinge 11, hinge 37 may be a piano hinge and has two hinge plates 37*a* and 37*b*. The hinge plates 37*a* and 37*b* are secured preferably to the bottom surfaces of sub-base parts 33 and 35 so that the upper surfaces of the sub-base parts are generally co-planar when the sub-base lies flat on the base 3. If desired, the hinge plates 37*a* and 37*b* can be secured to the top surfaces of the sub-base parts 33 and 35. The sub-base part 33 is connected to the base 3 at the beginning of the base and forms a "putting end" of the sub-base 31. The sub-base part 35 has a fixed end 39 which is connected to the plate 37*b* of the hinge 37 and a free end 41. An opening 43 is formed near the free end 41 and forms a "hole-end" of the sub-base 31. The opening 43 is preferably a rectangular opening which is 3"×5". It is slightly smaller in width than the standard 4" diameter of a cup on a golf green, however, it is longer than this diameter. A cup 45 is secured in opening 43 to capture a putted ball. The cup 45 is preferably flexible and loose, to substantially prevent the cup from acting as a trampoline or spring so that the ball will remain in the cup and will not bounce out of the cup. Preferably, the cup is a cloth cup and is made from netting. A sub-base handle 47 is secured at the free end 41 of sub-base part 35.

Figure 9:
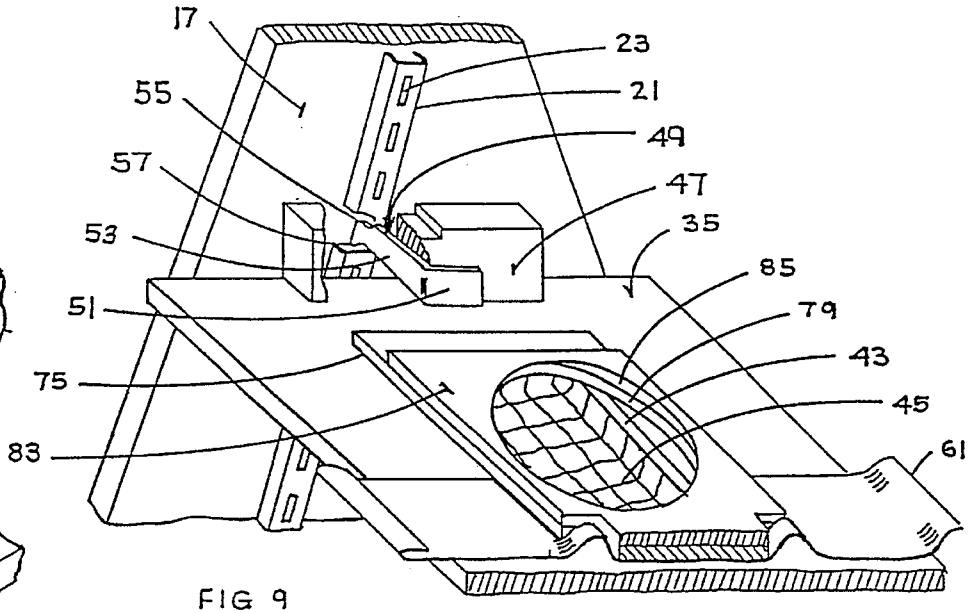
FIG. 9 is a perspective view, broken away and partly in cross-section, showing the connection of the track to the height indicator arm to place the device in an assembled condition.

As seen in FIG. 9, a hook 49 extends through a slot formed in the handle 47. The hook 49 includes a hook base 51 which lies along a front surface of the handle 47 and a hook arm 53 which extends through the handle 47 beyond the back surface of the handle 47. The hook arm 53 includes, at its free end, a notch 55 formed in its top edge and a notch 57 (best seen in FIG. 2) formed in its bottom edge. The notches 55 and 57 reduce the vertical size of the hook arm 53 so that the hook arm may be easily inserted in the openings 23 in the bracket 21. As illustrated in FIG. 9, the hook arm's bottom notch 57 engages a bottom edge of a bracket opening 23 so that the hook arm and bracket 21 will not become disengaged.

Figure 12:
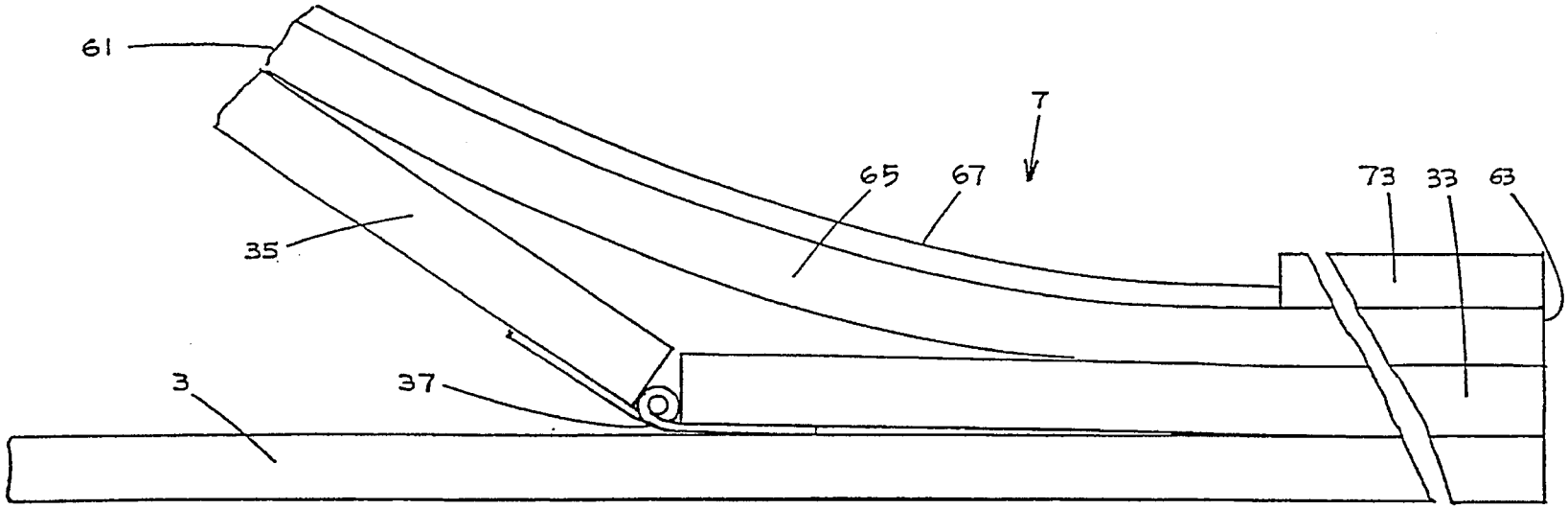
FIG. 12 is an enlarged view showing the manner in which the track of the device pivots relative to the base.

The track 7 includes a putting sub-surface 61 (FIG. 10) which lies on top of sub-base 31. The putting sub-surface 61, as can be seen in FIGS. 10 and 12, has an end 63 which is substantially flush with the front end of base 3 and sub-base part 33 and, as seen in FIG. 9, extends at least to the opening 43 in sub-base part 35. The sub-surface 61 has a cut-out 64 at its end 66, such that part of the sub-surface extends beyond the forward edge of the opening 43 in the sub-base 31. (See FIG. 10) The cut-out 64 is shaped to fully expose the sub-base opening 43. The putting sub-surface 61 is preferably vinyl. Four inch flat vertical vinyl siding cut to a width of about 11½" has been found to work quite well. Other materials could be used as well. The sub-surface 61 includes outer edges 65 which are up-turned and two parallel spaced-apart ribs 67 intermediate of the outer edges. The outer edges extend the length of the sub-surface 61, and the ribs 67 extend to the cut-out 62 and sub-base hole 43. The two outer edges 65 and two inner ribs 67 define three alleys: two outer alleys 69 and a middle alley 71. The outer alleys 69 and the inner alley 71 each have a width of about 3". The end 63 of the putting sub-surface 61 is fixed to the sub-base part 33 and the putting end of the base 3 by a pair of stiffening braces 73. This is the only point at which the sub-surface 61 is secured to the sub-base 31 and the base 3. Fasteners, such as screws, nails, etc., extend through the braces 73, sub-surface 61, and sub-base 31 to connect the track to the base 3. Braces 73 are positioned in the center of the outer alleys 69 between the ribs 67 and up-turned edges 65. The portion of sub-surface which is secured to the sub-base 31 defines a putting area of the track 7. Preferably, the putting area is between about 1¼' and about 2' long.

A flexible board 75 extends from the beginning of the putting end of sub-surface 61 and continues past the end of the sub-surface. The board 75 lies on the sub-surface 61 between the ribs 67. Board 75 is preferably approximately equal to the width of the alley 71 between the ribs 67, and has a width of about 3". As seen in FIG. 10, board 75 has an enlarged head 77 and the sub-surface cut-out 64 is sized to accommodate the head 77 of the board 75. A putting hole 79 is formed in the head 77 and overlies the opening 43 in the sub-base part 35. As seen in FIG. 12, the board 75 must be able to bend to accommodate the pivoting of the sub-base second section 35. This will ensure that there is a smooth transition between the flat putting section and the ramped section of the track 7.

Lastly, a putting surface or carpet 81 is positioned on top of board 75 and is shaped to correspond to the shape of board 75. The carpet 81 also defines a head 83 having a 4" diameter putting hole 85 formed therein. To increase the difficulty of the putt, the diameter of the putting hole 85 can be made as small as 2" (i.e., only slightly larger than a golf ball). If it is made much smaller than 2" the putting hole diameter will be less than the diameter of a regulation golf ball. The putting holes 79 and 85 of the board 75 and putting surface 81 are of equal diameter and are coaxial when the putting practice device 1 is assembled. The two holes 79 and 85 thus define a track hole.

Various materials can be used for the putting carpet 81. If the golfer wants to simulate putting under dry conditions, a thin carpet such as an indoor/outdoor carpet or Astroturf, may be used. The carpet used to simulate dry conditions is preferably about ¼" thick. To simulate putting under wet conditions, a thicker carpet is used. As can be appreciated, when a thicker carpet is used, the frictional forces applied against the ball will be greater, making the thicker carpet a "slower" surface. This will be akin to putting on a wet putting green.

The simulated putting conditions are also changeable simply by altering the elevation of the track without changing the putting surface. As can be appreciated, various putting green conditions, such as grass length and moisture content, simply affect the friction applied by the putting green to the ball, and hence the speed at which the ball will roll over the putting green (i.e., a fast putting green or a slow putting green). Thus, more or less force will be needed to putt a ball a given distance depending on the putting green conditions. This force is simulated simply by placing the track at the appropriate elevation, no matter what the putting surface on the track is. For example, to simulate a wet putting green, the track is elevated above that needed to simulate a dry putting green for a given distance. This will account for the extra force necessary to overcome the added frictional forces applied to the ball by the putting green.

The putting carpet 81 is preferably about 7' long. If the track 7 were to lie flat, the golfer could only practice 7' putts. However, by elevating the end of the track where the putting hole 85 is located, the golfer can simulate varying length putts. As can be appreciated, when the track is elevated, more force will be required to sink the ball into the putting hole at the end of the track, than is needed to sink the putt if the track were flat. This extra force corresponds to a putt of a determined distance and other specified conditions which affect the path and speed of a golf ball on a specified putting green in any golf course. Thus, if the golfer secures the hook 49 in a hole 23 in bracket 21 which has been calibrated under specified conditions for a 30' putt, the track would be pivoted to a certain angle. By changing the elevation, and hence the angle of the track 7, the forces acting on the golf ball will increase as the slope increases. Thus, the vertical arm 5 can be calibrated such that the force necessary to drive the golf ball into the hole at the end of the track is equal to the force necessary to sink a putt, for example of 30'. Therefore, if a golfer practices using putting at a desired elevation, his brain will "program and recall" the force needed to sink the putt at the distance corresponding to that elevation. With the proper stroke force "programmed", the golfer will be able to apply the same stroke force when he putts on an actual golf green.

The brace 73, which secures the track 7 to the sub-base first section 33, ensures that there is a flat putting section of the track. The end point of the brace 73, along with the stiffness of the board 75 and sub-surface 61, will determine where the track begins to ramp upwardly. Preferably, the sub-base first section has a length of about 1¼' to about 2½', and the flat or horizontal putting section of the track extends for most of this length. Preferably, the sub-base second section has a length of about 5¼'. I have found that with this length of ramped surface, the most common putting distances and conditions can be accommodated.

Figure 11:
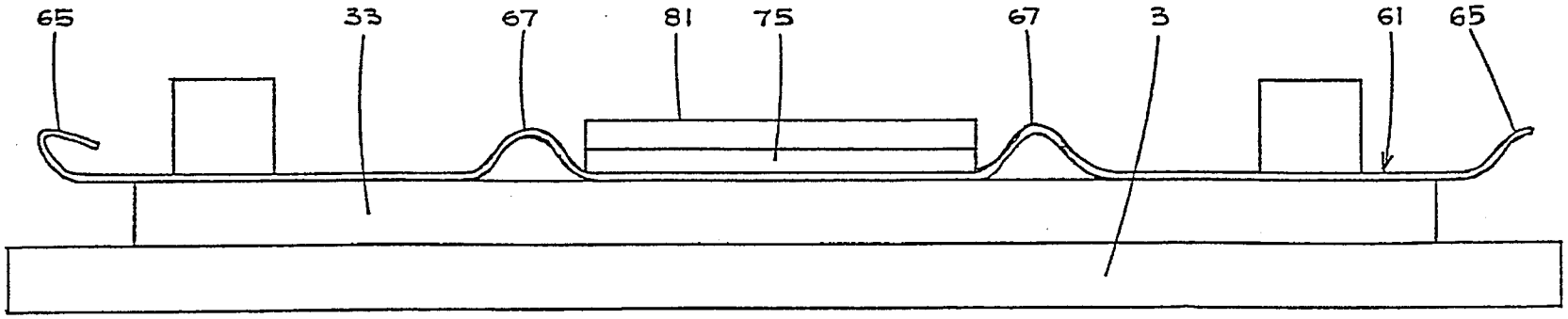
FIG. 11 is an enlarged front elevational view of the track.
Figure 13:
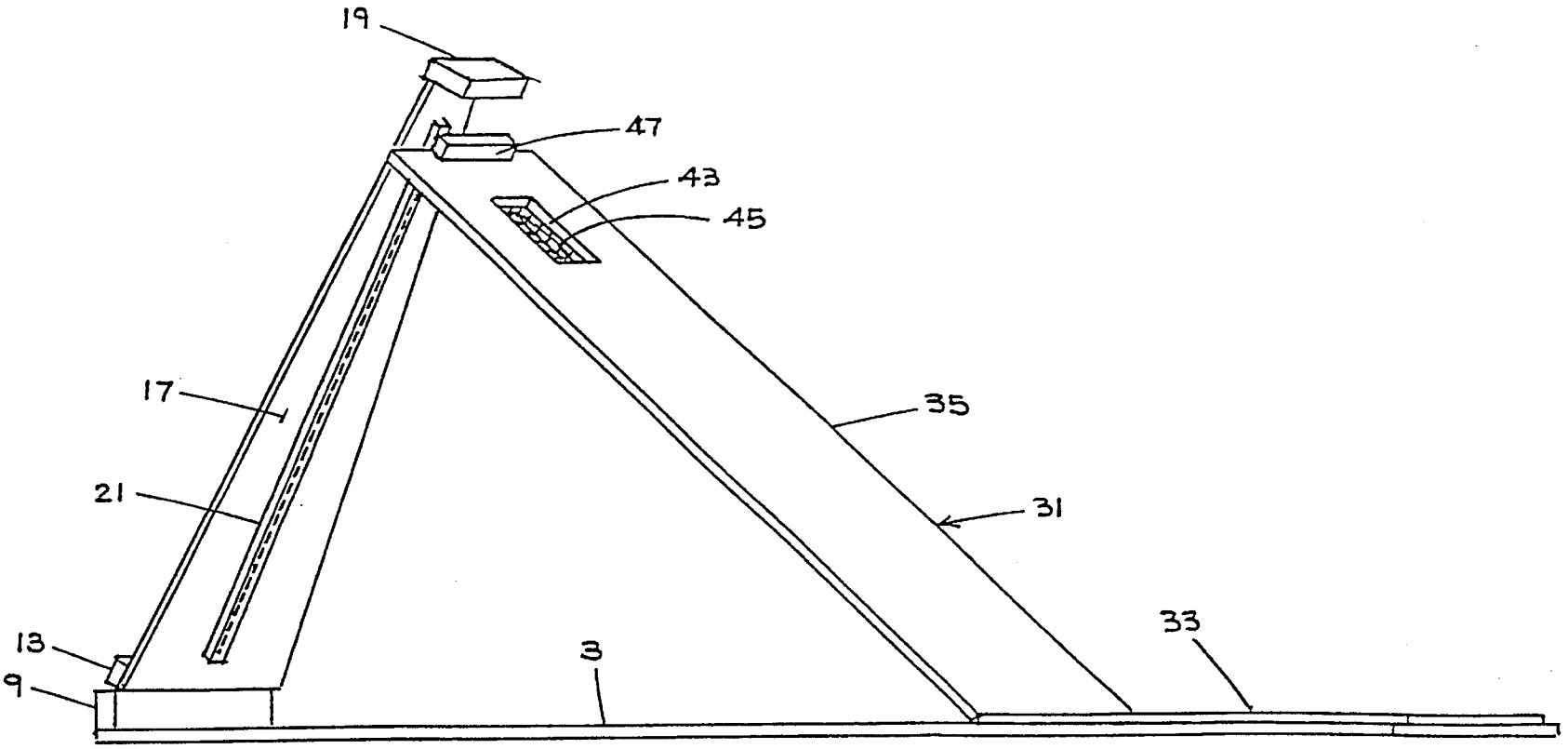
FIG. 13 is a perspective view of the device showing only the base, sub-base, and height indicator arm, all in an assembled state.

As seen in FIG. 11, the peaks of the ribs 67 are spaced from the putting surface 81. When the golfer putts, the path the ball travels along, i.e., the alley 71, is narrow (only about 4¾" wide). The golfer will thus be forced to putt substantially straight. The golfer will know if his putt is not proper if the ball begins to ride along one of the ribs 67. If the golfer putts properly, the ball will travel along the carpet 81 without contacting the ribs 67. If the putt is not sunk in the track hole, the ribs 67 or the upturned outer edges 65 of the sub-surface 61 will contain the ball, and the ball will roll down the track and return to the golfer. Unlike the prior devices, there is no wall forcing the golfer to hold the putter in a certain manner. Thus, the golfer will be able to experiment with ways to hold the putter if his putt is not straight.

As noted above, the putting sub-surface 61, and hence the board 75 and carpet 81, are secured to the sub-base 31 only on the putting portion 33 of the sub-base. The horizontal distance between the handle 47 in sub-base part 35 and the putting surface will shorten as the slope of the track is increased. The holes 79 and 85 in the heads of board 75 and carpet 81 will thus move forwardly relative to the hole 43 as the slope is increased. Because the rectangular opening 43 is longer than the diameter of the holes 79 and 85, there will always be an opening sufficiently large to allow the golf ball to fall through the holes and into the net 45. Although the opening 43 is disclosed to be 5", it could be made longer if necessary to accommodate the movement of the carpet 81 and board 75. Further, it will be seen that the opening 43 is slightly narrower than the diameter of the holes 79 and 85. This however, will not prevent the golf ball from falling into the cup 45 if the golf ball enters the holes 79 and 85 (i.e., if the golfer sinks the putt). The carpet 81 and board 75 are of a thickness (preferably about ¼") such that if the ball enters the "cup" of the practice device, the ball will fall into the net and will not bounce out. If desired, however, the opening 43 can be made wider and/or longer.

Figure 14:
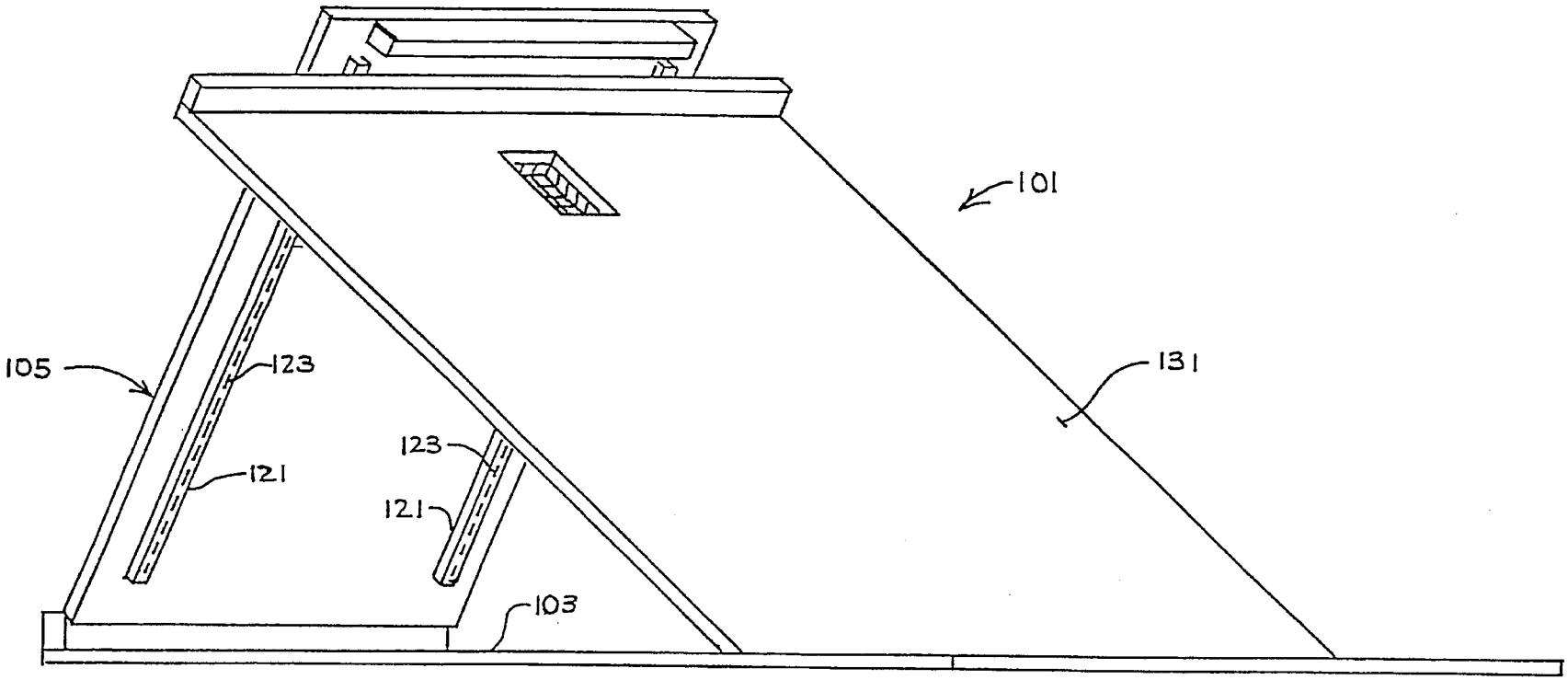
FIG. 14 is a perspective view, similar to FIG. 13 of an alternative embodiment of the putting practice device.

A second embodiment of the putting practice device is shown in FIG. 14. The putting practice device 101 is substantially similar to the putting device 1. The main difference is that the putting device 101 includes a base 103 and sub-base 131 which are substantially wider than the base 3 and sub-base 31 of device 1. Further, the sub-base 131 includes only the pivotal section which is hingedly connected directly to the base 103. There is no first section to the sub-base, such as section 33 of the sub-base 31, which is secured to the base 103 as there is with the device 1. The same track 7 is placed on sub-base 131 as is placed on sub-base 31. The sub-base 131 and base 103 are sufficiently wide that the golfer may stand on the base 103 so as to be on the same level as the track. This will simulate actual putting conditions better. The track 7 extends up the middle of the base 103 and sub-base 131 so that a golfer may stand on either side of the track. This will allow either left-handed or right-handed golfers to use the practice device 101. The height indicator arm 105 is wider than the arm 5 to accommodate the wider sub-base 131. Arm 105 is provided with two brackets 121 which are positioned near the edges of the arm 105. The use of the wider sub-base 131 and the two spaced apart brackets 121 will allow for the simulation of a break in the putt. The sub-base can be secured in different openings 123 in each bracket to give a slight sideways slope to the track.

Figure 15:
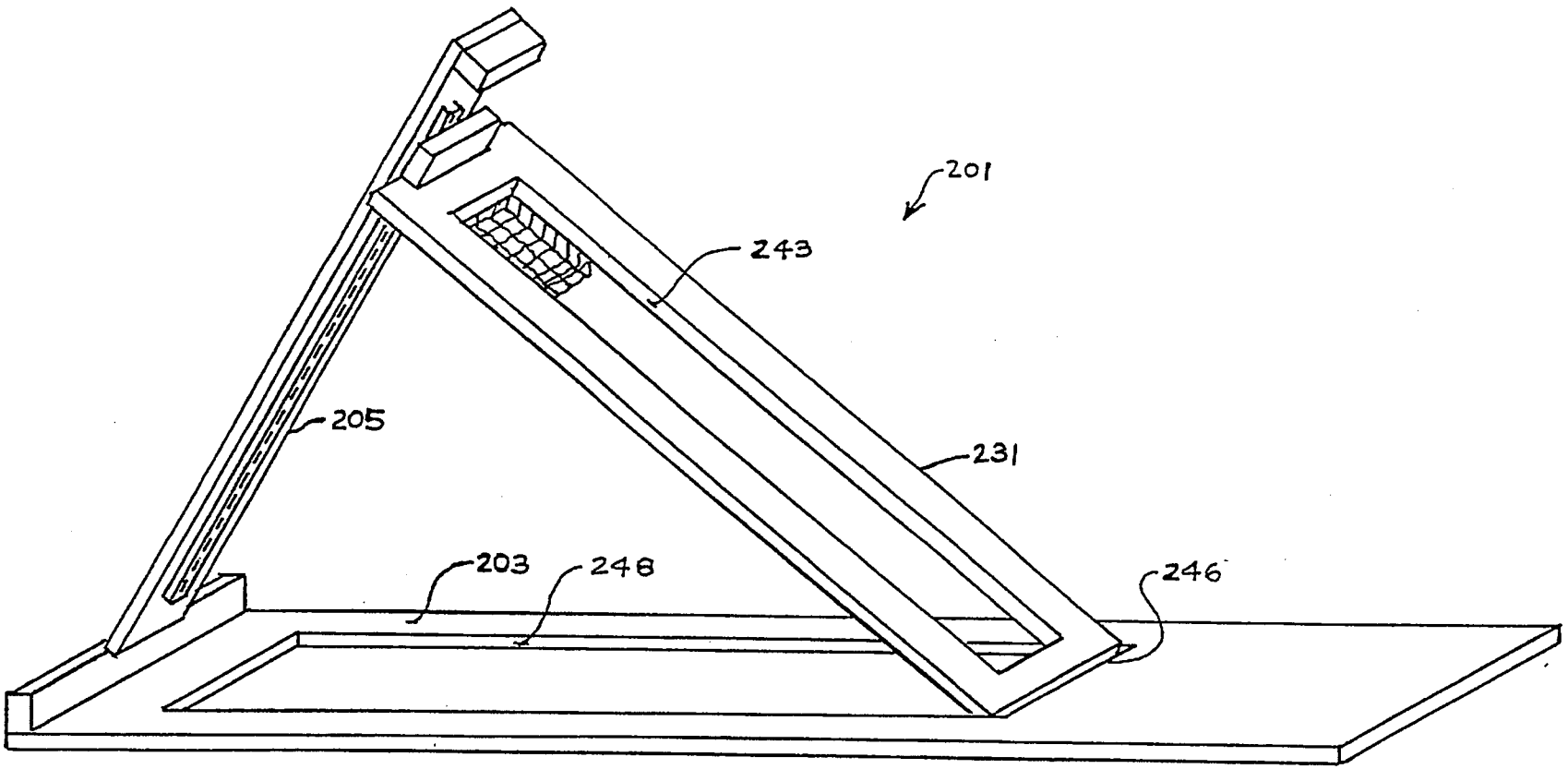
FIG. 15 is a perspective view, similar to FIG. 13 of a third alternative embodiment of the putting practice device.

A third embodiment of the putting practice device is shown in FIG. 15. The putting device 201 is designed to substantially reduce the weight and manufacturing cost of the putting device. The putting device 201 includes a base 203, a height indicator arm 205, and a sub-base 231. The track 7 is then placed over the forward or putting end of the base 203 and the sub-base 231. Unlike the putting device 1, the sub-base includes only a single pan, which forms the ramped portion of the track, rather than the two part sub-base 31 of putting device 1. In manufacturing the putting device 201, the sub-base 231 is cut from the base 203, and the height indicator arm 205 is cut from the sub-base 231. The sub-base 231 is hingedly connected to the edge 246 of the opening 248 formed in the base 203. The sub-base opening 243 is formed by cutting the arm 205 from the sub-base. Thus, the opening 243 is substantially longer than the opening 43 of putting device 1. This allows for greater leeway in the amount of movement of the track 7 relative to the sub-base 231 as the track is elevated. As can be appreciated, because the base, sub-base, and height indicator arm are formed from a single sheet, rather than being formed from three separate sheets, the weight of the practice device 201 will be substantially reduced. This will greatly reduce the manufacturing costs of the putting device and the shipping costs of the completed and assembled device. If the base, sub-base, and height indicator arm are to be molded of plastic, rather than cut from a board, the same weight reduction can be achieved by forming the equivalent openings in the base 203 and sub-base 231, and by making the height indicator arm narrow, as shown in FIG. 15.

As variations within the scope of the appended claims may be apparent to those skilled in the art, the foregoing description is set forth only for illustrative purposes and is not meant to be limiting. For example, bracket 21 could be replaced by slots formed directly in the brace 15 or the board 17. The bracket 21 could also be replaced by a rotatable threaded shaft to which the track 7 is mounted. The height of the track 7 along arm 5 could be changed by rotating the threaded shaft. This shaft could be rotated manually by a crank, or by a motor. The bracket can also be replaced by a hydraulic system. In the last two instances, i.e., the use of the shaft and hydraulic system, the track could be stopped at any position along the track, whereas when the openings 23 are used, either in a bracket or the board 17, the track can only be mounted at discrete locations. The putting surface can be varied so that a much shorter track can be used to simulate the same putting lengths. The length of the track, or of either of the two sections of the sub-base can thus be altered without effecting the effectiveness of the device as a practice device for long putts. If the putting sub-surface 61 is sufficiently rigid, the board 75 can be eliminated. The putting sub-surface could also be designed to eliminate the need for the sub-base. The putting sub-surface 61 would be increased in length to define the opening 43 which is formed in the sub-base, and the hook 49 and handle 47 would be mounted to the end of the sub-surface 61. If desired, the alley 71 of the putting sub-surface 61 may be used as the putting surface. This would eliminate the need for a separate putting surface. The sub-base could be provided with side rails which would perform the same function as the upturned edges 65 of the sub-surface 61. This would allow for the use of a sub-surface which is less complicated to form and which would only include the ribs 67. These examples are merely illustrative.

I claim:

1. A golf putting practice device which will enable a golfer to practice putts of varying distances and conditions which affect the speed and path of a golf ball on a putting green; the device including:

a base including a first end and a second end;

a height indicator arm hingedly connected to the base near said second end;

a pivotal sub-base which is hingedly connected to said base, said sub-base including a fixed end and a free end, said fixed end being connected to said base intermediate said first end and said second end of said base, a portion of said base between said base first end and said fixed end of said pivotal sub-base defining a putting section of said device; said pivotal sub-base defining a ball travel surface and having a hole near said free end, said hole being sized to allow a golf ball to fall therethrough;

a track including a putting end and a hole end, said track being connected to said base putting section and lying over said pivotal sub-base;

said pivotal sub-base being selectively securable to said height indicator arm at a desired point along said height indicator arm.

2. The device of claim 1 including a fixed sub-base secured on said base between said base first end and said pivotal sub-base, said putting end of said track being secured to said fixed sub-base, said pivotal sub-base being hingedly connected to said fixed sub-base at an end of said fixed sub-base.

3. The device of claim 1 wherein said height indicator arm may be pivoted relative to said base to a folded position in which said height indicator arm is substantially parallel to said base.

4. The device of claim 3 including a pedestal secured to said base near said base second end, said height indicator arm being pivotally secured to said pedestal such that a lower edge of said height indicator arm is spaced from an upper surface of said base.

5. The device of claim 4 wherein said height indicator arm includes a handle near a top of said height indicator arm, said handle extending generally perpendicularly from said height indicator arm.

6. The device of claim 5 wherein said height indicator arm handle has a height approximately equal to the height of said pedestal.

7. The device of claim 1 wherein said height indicator arm includes at least one set of spaced apart co-linear openings, said pivotal sub-base including a hook at said free end which is removably receivable in a desired one of said openings to elevate said hole end of said track to a desired height.

8. The device of claim 7 including indicia adjacent a plurality of said openings of said set of openings, said indicia corresponding to putting distances simulating specified conditions which affect the path and speed of said golf ball on a specified putting green.

9. The device of claim 8 wherein said pivotal sub-base includes a handle near its free end, said hook extending through said handle to be engaged with a selective one of said openings.

10. The device of claim 7 wherein said height indicator arm includes an elongate bracket, said openings being formed in said bracket.

11. The device of claim 1 wherein said track includes a flexible putting sub-surface and a putting surface, said putting sub-surface being mounted to said base, said putting surface being on said putting sub-surface, said putting sub-surface extending from said base first end to at least said hole in said pivotal sub-base, said putting sub-surface being formed to expose said hole in said pivotal sub-base; said putting sub-surface having a pair of spaced apart longitudinally extending ribs, said ribs defining an alley, said putting surface being in said alley.

12. The device of claim 11 wherein said putting sub-surface has a width greater than the width of said putting surface, said putting sub-sin,face including a second pair of ribs spaced from said first pair of ribs, said second pair of ribs cooperating with said first pair of ribs to define outer alleys.

13. The device of claim 12 including a pair of elongate attachment bars in said outer alleys, said attachment bars including fasteners which secure said track to said base along a desired length of said track.

14. The device of claim 11 wherein said putting surface is independent of said putting sub-surface and is secured to said putting sub-surface, said putting surface simulating a desired putting green condition.

15. The device of claim 14 wherein said track includes a hard board which is positioned between said putting surface and said putting sub-surface, said hard board and said putting surface each having a hole, the holes of said hard board and putting surface being coaxial and substantially equal in size to define a track putting hole, said track putting hole being aligned with said hole in said pivotal sub-base.

16. The device of claim 15 wherein the hole of said pivotal sub-base has a length greater than the length of said track putting hole.

17. The device of claim 16 wherein said pivotal sub-base includes a cup beneath said hole to capture a golf ball.

18. The device of claim 17 wherein said cup is made of a flexible fabric.

19. The device of claim 18 wherein said flexible fabric is netting.

20. The device of claim 1 wherein said base and said sub-base are substantially wider than said track, said track extending up the middle of said base and said sub-base.

21. A golf putting practice device which will enable a golfer to practice putts of varying distances and various specified conditions of a putting green which affect the path and speed of a ball on the putting green; the device including:

a base including a first end and a second end;

a height indicator arm hingedly connected to the base near said second end; said height indicator arm including at least one set of co-linear spaced apart openings extending substantially the height of said height indicator arm;

a flexible track on said base, said track including a fixed end which is secured to said base at said base first end along a desired distance of said track to define a putting end of said track and a free end having an opening therein to define a hole end of said track;

a hook operatively connected to said track free end, said hook being insertable in a selected one of said height indicator arm openings to raise said hole end of said track to a desired height.

22. The golf putting practice device of claim 21 further including a sub-base having at least a pivotal section; said pivotal section including a free end and a fixed end and being pivotally connected at its fixed end to said base; said pivotal section having a hole near said sub-base free end and a cup beneath said hole to capture a golf ball, said hole being sized to allow a golf ball to fall therethrough; said sub-base hole being exposed through said track hole, said hook being mounted to said sub-base free end.

23. The golf putting practice device of claim 22 wherein said track includes a flexible putting sub-surface secured to said base and a putting surface on said putting sub-surface, said putting sub-surface extending from said first end of said base to at least said hole in said sub-base, said putting sub-surface being formed to expose said hole in said sub-base; said putting sub-surface having a pair of spaced apart longitudinally extending ribs, said ribs defining an alley, said putting surface being disposed in said alley; said putting surface including a hole sized to receive a golf ball, said putting surface hole being aligned with said hole in said sub-base, said hole of said sub-base having a length greater than the diameter of said putting surface hole.

* * * * *